United States Patent [19]

Benedyk

[11] 4,258,097

[45] * Mar. 24, 1981

[54] NON-WOVEN LOW MODULUS FIBER FABRICS

[75] Inventor: Joseph C. Benedyk, Highland Park, Ill.

[73] Assignee: Brunswick Corporation, Skokie, Ill.

[ * ] Notice: The portion of the term of this patent subsequent to Jan. 1, 1997, has been disclaimed.

[21] Appl. No.: 33,480

[22] Filed: Apr. 26, 1979

[51] Int. Cl.[3] ..... D02G 3/00; D04H 1/00

[52] U.S. Cl. ..... 428/224; 28/107; 428/300; 428/359; 428/365; 428/372

[58] Field of Search ..... 428/224, 300, 359, 364, 428/365, 372; 526/331; 28/107, 108, 110

[56] References Cited

U.S. PATENT DOCUMENTS

| | | | |
|---|---|---|---|
| 2,910,763 | 11/1959 | Lauterbach | 428/300 |
| 3,081,485 | 3/1963 | Steigerwald | 264/24 X |
| 3,086,275 | 4/1963 | Pritchard | 428/394 |
| 3,206,351 | 9/1965 | Smith | 428/300 X |
| 3,591,674 | 7/1971 | Engel | 264/210.1 |
| 3,801,428 | 4/1974 | Striegler et al. | 428/359 X |
| 3,803,453 | 4/1974 | Hull | 317/2 R |
| 3,935,046 | 1/1976 | Kiernan et al. | 428/300 X |
| 3,976,631 | 8/1976 | van der Molen et al. | 526/64 |
| 3,994,759 | 11/1976 | Stoller | 428/300 X |
| 4,078,128 | 3/1978 | Koch et al. | 526/331 X |
| 4,082,658 | 4/1978 | Fritzsche | 260/DIG. 23 X |
| 4,181,762 | 1/1980 | Benedyk | 428/364 |

*Primary Examiner*—Lorraine T. Kendell

*Attorney, Agent, or Firm*—John G. Heimovics; William G. Lawler, Jr.

[57] ABSTRACT

Non-woven fabrics suitable for use as carpeting and the like are produced by needlepunching staple length monofilament fibers having an elastic modulus of from 5,000 to 60,000 psi. The fibers are also characterized by an area moment of inertia of from $400\times10^{14}$ to $7{,}000\times10^{14}$ in$^4$ and a stiffness parameter of from $1\times10^{-5}$ to $1\times10^{-8}$ lb-in$^2$.

34 Claims, 7 Drawing Figures

NON-WOVEN LOW MODULUS FIBER FABRICS

CROSS-REFERENCES TO RELATED APPLICATIONS

This application is related to copending application Ser. No. 017,465, now U.S. Pat. No. 4,181,762 of Joseph C. Benedyk, entitled "Fibers, Yarns and Fabrics of Low Modulus Polymer."

BACKGROUND OF THE INVENTION

This application relates generally to non-woven fabrics produced from low modulus polymeric materials and to a method for their manufacture.

More specifically, this invention relates to non-woven, needle bonded fabrics manufactured from fibers having a unique combination of physical properties.

Historically, man-made fibers have been engineered so that the physical properties of such fibers are about the same as textile fibers found in nature, for example, cotton or wool. Natural textile fibers are generally thin, having a diameter less than about 2 mils and having a high elastic modulus, for example, a modulus greater than about 200,000 psi. Thus, synthetic fibers are thin and have a high modulus. For example, a typical commercially-available, polyethylene monofilament having a tensile strength of about 28,500 psi displays an elastic modulus of about 340,000 psi. Such thin, high modulus fibers have a stiffness parameter generally ranging between about $1\times10^{-5}$ and about $1\times10^{-8}$ lb-in$^2$. In general, any fiber having a stiffness parameter within this range will feel soft and pliant. Because conventional fibers have a relatively high elastic modulus, usually well above 200,000 psi, they must have a relatively low moment of inertia, otherwise they would feel too stiff.

Elastic modulus, designated as $E_f$, is determined by measuring the initial slope of the stress-strain curve derived according to ASTM standard method No. D2256-69. Strain measurements are corrected for gauge length variations by the method described in an article entitled "A Method for Determining Tensile Strains and Elastic Modulus of Metallic Filaments," ASM Transactions Quarterly, Vol. 60, No. 4, December 1967, pp. 726–27.

The moment of inertia, designated $I_f$, of a fiber is a function of its cross-sectional area. Under normal loading conditions, fibers bend about a neutral axis where the moment of inertia will be a minimum value. The moment of inertia about this neutral axis is calculated using the following equation:

$$I_f=\int y^2 dA$$

Where dA is any incremental area of the fiber's cross-section and y is the distance any such incremental area is from the neutral axis.

For fibers with a uniform circular cross-sectional configuration, the moment of inertia ($I_f$) may be calculated by the following formula:

$$I_f=\pi d^4/64$$

where d is the fiber diameter. Specific equations for calculating the moments of inertia of fibers having a cross-sectional configuration other than circular are given in a paper presented at the 47th annual meeting of the ASTM, Vol. 44, (1944).

The stiffness parameter of a fiber, designated $K_f$, is a general indicator of the feel, or hand, of a fabric made from that fiber. When considering the hand of any fiber, one must take into account the specific textile construction in which the hand is being judged. In a non-woven needle punched fabric of light weight, for example, the feel of the fabric depends upon the texture, flexibility and overall softness of the fabric.

Somewhat different, but related, criteria apply to heavier, non-woven fabrics used as carpeting. In this application, one primary consideration is the walking comfort or "underfoot bounce" of the carpet. This property is related to the ability of the carpet to absorb energy and give a comfortable feel underfoot.

Another consideration of importance in carpet fabrics is the appearance of the floor covering after use. This property is related to the fabric's ability to recover from compressive forces which in turn depends heavily on the energy absorbed in compression. Although some of the energy can be recovered in the form of viscoelastic work, much of it is lost and is manifested as a permanent deformation of the pile. The effect of abrasion coupled with the inability of a fabric to recover from deformation is commonly referred to as matting which manifests itself as a deterioration in the visual appearance of the carpet.

Although other factors affect the hand of pile fabrics, the chief factor is the fiber stiffness which is a function of the material properties of the fiber, the geometry of the fiber and the manner in which load is applied to the fiber. In general terms, one may compare the hand of different fabrics by comparing the stiffness parameter of the fibers, where each fiber has a uniform cross-section and is composed of the same material throughout. This stiffness parameter is the product of the elastic modulus of the fiber and the area moment of inertia of the fiber:

$$K_f=E_f\times I_f$$

DISCUSSION OF THE PRIOR ART

A number of thermoplastic polymeric materials having an elastic modulus in the range of 5,000 to 60,000 psi are known and are commercially available. Examples of such known and commercially available polymers include ethulene-vinyl acetate copolymers, plasticized polyvinyl chloride, low density polyethylene, ethylene-ethyl acrylate copolymer, ethylene-butylene copolymer, polybutylene and various copolymers thereof, certain ethylene-propylene copolymers, chlorinated polypropylene, chlorinated polybutylene and various compatible mixtures of these thermoplastics. However, the prior art has consistently viewed these polymers as unsuitable for use in fibers precisely because of their low elastic modulus and also because of their uniformly low tensile strength.

It is also known to produce elastomeric fibers from various rubbery polymers as, for example, spandex which comprises a synthetic polymer of a segmented polyurethane. Elastomeric fibers comprising an ethylene-vinyl acetate copolymer are also known as is disclosed in German Pat. No. 1,278,689. Copolymers used have a vinyl acetate content of 40 to 45% and fibers are spun from a solution of the polymer in a solvent such as methylene chloride. Elastic modulus of the fibers produced by the process of the German Patent is about 0.08–0.09 Kp/mm$^2$ which, in English units, is about 120–130 lb/in$^2$.

The use of needle punching techniques to manufacture carpeting fabrics is also known and used in the art. An exemplary patent describing use of needle punching in carpet manufacture is U.S. Pat. No. 3,497,414.

SUMMARY OF THE INVENTION

I have found that needle bonded fabrics, especially heavy fabrics suitable for use as carpeting, may be manufactured of polymeric materials heretofore considered completely unsuited for such use provided that certain criteria are met. The polymeric material must have an elastic modulus in the range of about 5,000 to about 60,000 psi and will typically display an ultimate tensile strength in the range of about 5,000 to 50,000 and preferably in the range of 5,000 to 20,000 psi. The fiber itself, which may be produced in monofilament form by extrusion through an orifice, must display an area moment of inertia from $400\times10^{-14}$ to $7{,}000\times10^{-14}$ in$^4$ and a stiffness parameter of from $1\times10^{-5}$ to $1\times10^{-8}$ lb-in$^2$.

Monofilament fibers are cut or chopped to staple length, are laid on a work surface to form a uniform web and thereafter needle bonded to form a coherent felt or fabric. The resulting fabric displays esthetic qualities comparable to those made of conventional carpet fibers, such as polypropylene, at a small fraction of the material cost. In addition to substantial economic advantages, fabrics produced from my fibers display good matting resistance, greater cleanability, better inherent antistatic properties, a lesser tendency to produce carpet burns and a greater resistance to damage from hot objects such as cigarettes than do fabrics of conventional fibers.

Hence, it is an object of my invention to provide non-woven fabrics of low modulus fibers displaying esthetic qualities comparable to those of traditional fibers.

Another object of my invention is to provide a method for manufacturing non-woven fabrics.

A specific object of my invention is to provide low-cost, high quality non-woven fabric suitable for use as carpeting.

GENERAL DISCUSSION OF THE INVENTION

As the cost of the traditional synthetic carpet fibers, principally nylon and to a lesser extent polypropylene and the like, have increased substantially over the past few years, lower cost substitutes having similar physical characteristics are being sought. The search for alternatives to the traditional carpet fibers has focused almost exclusively on attempts to duplicate, or substantially duplicate, their properties, i.e., high elastic modulus, thermoplasticity, high tensile strength and relatively high melting point. I have found that by concentrating instead upon the properties desired in the manufactured fabric, physical parameters of a fiber can be set to achieve the desired properties using polymeric materials heretofore considered inappropriate or unacceptable for fiber use.

Specifically, I have found that the esthetic qualities of high-grade fabrics of traditional fibers can be substantially duplicated or even improved upon by selecting a low modulus polymer and producing fibers therefrom having an increased diameter, or cross-sectional area, such that the resulting stiffness parameter is equivalent to that displayed by those traditional fibers.

The chief criterion for selecting a polymeric material for use in my invention is its elastic modulus. The best material discovered so far is an ethylene-vinyl acetate copolymer having a vinyl acetate content ranging from about 1 to about 20 percent by weight and a melt index of from about 0.5 to about 9. This material will provide the monofilament with the desired elastic modulus and is also relatively inexpensive. The following are examples of thermoplastic materials which will provide the monofilament with an elastic modulus within the range of from 5,000 to 60,000 psi: (a) plasticized polyvinyl chloride, (b) low density polyethylene, (c) thermoplastic rubber, (d) ethylene-ethyl acrylate copolymer, (e) ethylene-butylene copolymer, (f) polybutylene and copolymers thereof, (g) ethylene-propylene copolymers, (h) chlorinated polypropylene, (i) chlorinated polybutylee, or (j) mixtures of these thermoplastics.

Although the ethylene-vinyl acetate copolymer has the desired elastic modulus, one problem with this material is that it has a relatively low melting point. To obviate this problem and increase the heat resistance of the fiber, the molecules of the copolymer are cross-linked. Cross-linking may be achieved either during the manufacture of the fiber or subsequently. Conventional irradiation techniques may be employed or the molecules of the polymer may include moieties which react under selected conditions with other molecules to effect cross-linking. As will be discussed below in detail, it is desirable to use certain additives which greatly enhance cross-linking. Only partial cross-linking is desired so that the material retains the required elastic properties. Ordinarily, cross-linking increases the melting point of the material so that it is 200° F. or greater.

The cross-sectional configuration of fibers used in my invention is not critical so long as the moment of inertia falls within the range of from about $400\times10^{-14}$ to about $7{,}000\times10^{-14}$ in$^4$. However, the fibers preferably have a generally circular cross-section. Consequently, to have the required moment of inertia ($I_f$), such a fiber would have a diameter in a range of from about 3 to about 6 mils, preferably from about 4 to about 5 mils. In terms of denier, the fibers usually have a denier of from 25 to 150 for materials having a specific gravity in the range of from about 0.90 to about 1.4.

The larger diameter fibers used in my fabrics tend to increase the resistance to matting as there is a lessened tendency for the fibers to become entangled with one another. As a general rule, the smaller the fiber diameter and the closer the fibers are packed together in a fabric, the greater will be the frictional forces holding the fibers in a matted condition.

Because of the larger fiber diameter there are a fewer number of fibers per unit area in my fabrics as compared to conventional fabrics of equivalent weight. Consequently, my fabrics tend to have a cooler feel than do conventional fabrics.

The fabric of my invention also has a slightly smoother feel than do conventional needle punched fabrics of other synthetic fibers. This is mainly due to the reduced number of fibers per unit area. Because fewer fibers are present, the coefficient of friction of the fabric of my invention is less than the coefficient of friction of conventional needle punched fabrics.

The lower coefficient of friction and poorer insulating properties of my fabric actually provide an advantage, namely, reduction of carpet burns. Carpet burns are caused by rapidly rubbing one's skin against the pile. Carpets having a high coefficient of friction and good insulating properties are more likely to produce a carpet burn. The reason is that the higher coefficient of friction produces more heat which, due to the carpet's good insulating properties, is not conducted away from the skin.

In abrasive wear, rubbing action forces tiny dirt particles to cut through fibers. Nylon, for example, being a hard material, is not readily cut by these particles. In contrast, the material I use in my fiber is substantially softer than nylon. Thus, in abrasive wear, dirt particles will cut through my fiber with less difficulty. Because more material is present, my fiber, however, will wear as well as nylon fiber which is relatively thin.

DETAILED DESCRIPTION OF THE INVENTION

Figure 1:
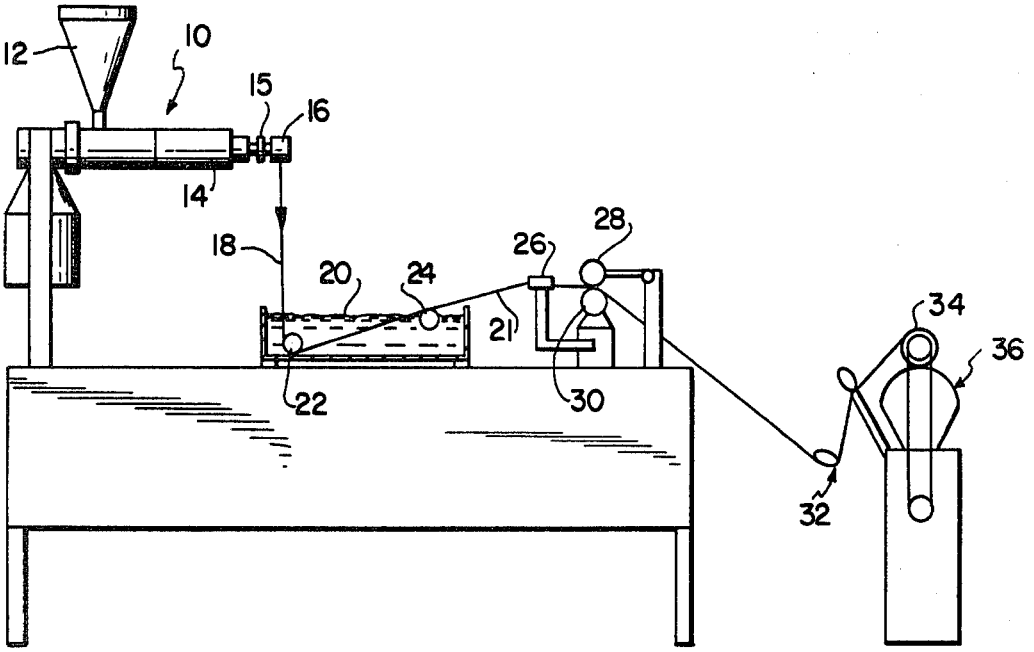
FIG. 1 is a side elevational view of an extruder and draw-line used in spinning the fiber of my invention.

Referring first to FIG. 1, there is shown a preferred method of making the fibers of my invention. Polymeric material having the proper elastic modulus is extruded into a plurality of monofilaments using a conventional extruder 10 as is described in a paper presented by D. Poller and O. L. Riedy, "Effect of Monofilament Die Characteristics on Processability and Extrudate Quality", 20th Annual SPE Conference, 1964, paper XXII-2. Extruder 10 includes a hopper 12 into which pellets of polymeric material are deposited, an extruder barrel 14 where the pellets are melted, a static mixer 15, and a spinnerette plate 16 through which the molten polymeric material is forced.

The melted polymeric material leaves the spinnerette plate 16 as a plurality of molten strands 18 of polymer which continuously flow downwardly into a water bath 20 maintained at a temperature in the range of ambient to about 150° F. When the molten polymer strands strike the water in the bath 20, they are chilled rapidly and become a continuous solid monofilament fiber 21. This fiber passes around a pair of guides 22 and 24 and through a guide plate 26 into the nip of a pair of rollers 28 and 30. These rollers 28 and 30 pull on the fiber to draw the molten polymer strands 18 so that each strand has a diameter of about 6 to about 15 mils and preferably from about 7 to about 9 mils. On leaving the rollers 28 and 30, the solid monofilaments pass through a fiber guide/braking system 32 and are wrapped about spools 34 mounted on a winder 36.

Figure 1A:
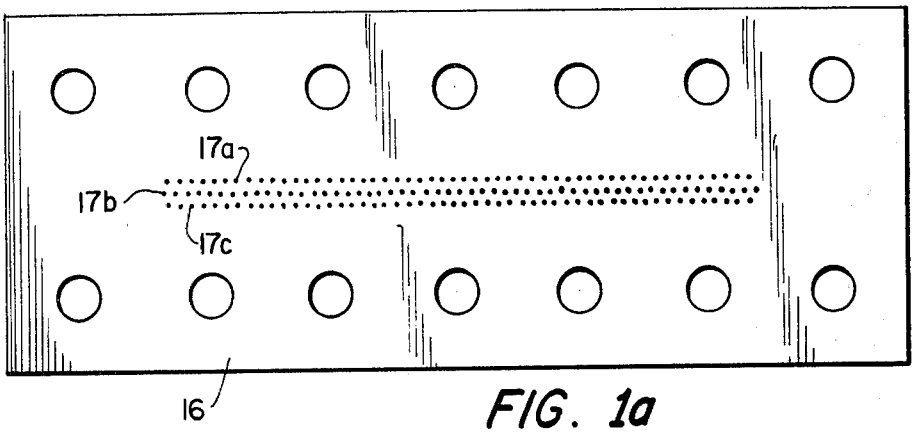
FIG. 1*a* is a front elevational view of the spinnerette plate.
Figure 1B:
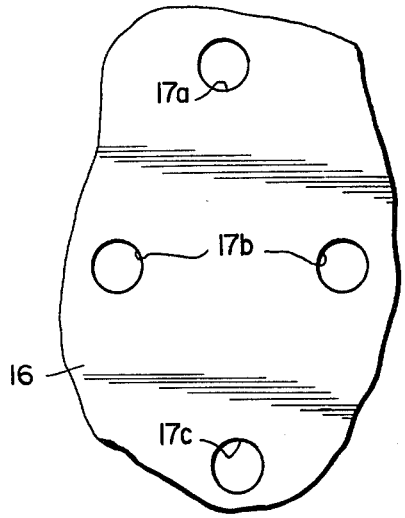
FIG. 1*b* is an enlarged fragmentary view of the orifices in the spinnerette plate.

FIG. 1*a* illustrates in detail spinnerette plate 16 which may include three rows 17*a*, 17*b*, and 17*c* of aligned orifices or holes. For extruding monofilaments to form the fibers of my invention, the orifices preferably have an area in the range of from $8\times10^{-5}$ to $70\times10^{-5}$ in$^2$. As shown in FIG. 1*b*, the holes making up the central row 17*b* are offset at an angle of about 60° with respect to the holes in top and bottom rows 17*a* and 17*c*. The spacings between the top row 17*a* and the center row 17*b* and the bottom row 17*c* and the center row 17*b* are each approximately 0.065 inch. The spacing between adjacent holes in any one row is approximately 0.075 inch. The holes may be straight or tapered at an angle of approximately 15° to 30°.

Figure 2:
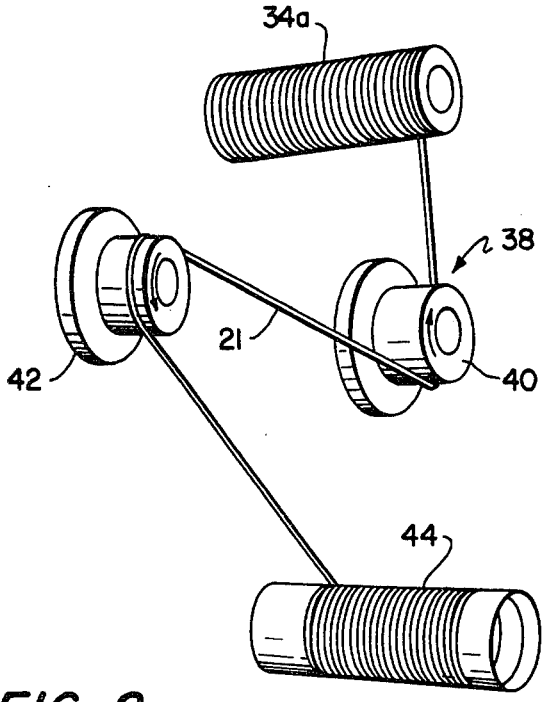
FIG. 2 is a conventional draw-winding apparatus for drawing or stretching the fiber at temperatures below 100° F.

Turning now to FIG. 2, there is shown the drawing of monofilaments in the solid state. This solid state drawing is performed at a temperature below about 100° F. and reduces the diameter of the extruded monofilaments from about 6 to 15 mils to about 3 to 6 mils. A spool 34*a*, loaded with multiple strands of monofilament is removed from the winder 36 of FIG. 1 and placed on the draw winding apparatus 38 shown in FIG. 2. The lead ends of the fibers 21 on the spool 34*a* are unwound, guided about two drawing godets 40 and 42, and wrapped around a second spool 44. These godets 40 and 42 turn at different angular velocities so the fibers 21 coming off the spool 34*a* are stretched.

Figure 3:
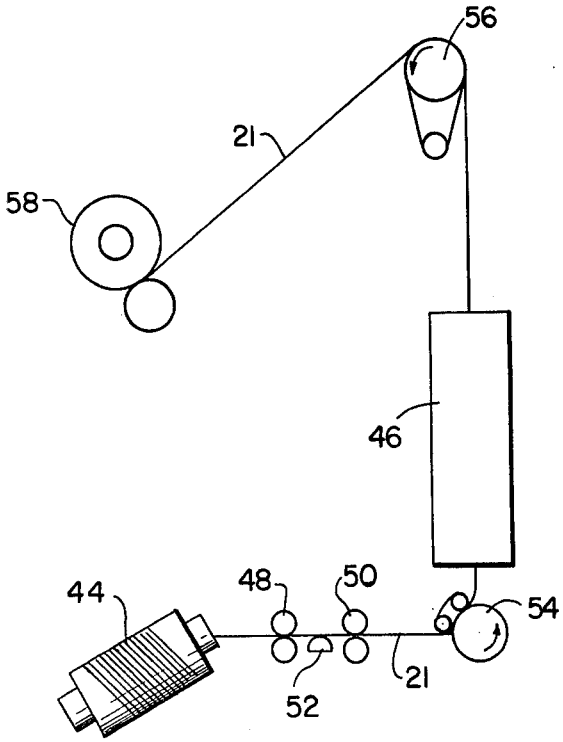
FIG. 3 is a side elevational view of the apparatus used to heat the fiber under tension.

The drawn, solid monofilaments are then subsequently heated to a temperature above about 100° F. but below their melting point to heat set the fibers so as to increase their shrink resistance. As shown in FIG. 3, fibers 21 from spool 44 first pass through a pair of draw rolls 48 and 50 which pull the fiber over a pre-heater 52 and feed the fiber into the nip of an input feed roll assembly 54. The fibers pass through the heater 46 and over a feed roll 56 to the takeup spool 58. When the fibers comprise a copolymer of ethylene and vinyl acetate, the preferred heater temperature is in the range of about 150° to 200° F. The tension on fibers 21 as they pass through the heater 46 is sufficient to prevent them from shrinking. Fibers 21, however, are not stretched so their diameter remains unchanged through the heating step.

To improve the heat resistance of the fiber, it is preferred to partially cross-link the molecules of the polymeric material. This may be achieved by mixing a free radical former such as a peroxide, e.g. ditertiary butyl peroxide with the polymeric material and then adding a monomer having at least two vinyl groups as the cross-linking agent such as for example, divinyl benzene, trivinyl benzene, diallyl phthalate, triallyl cyanurate, etc. Cross-linking polyethylene or ethylene-vinyl acetate copolymers is well known and is illustrated by British Pat. No. 853,640, for example, which lists many peroxy activators and cross-linking monomers. Peroxides alone are known cross-linkers for the polyethylenes. A vinyl silane grafted on the polyethylene chain by a peroxide may serve as a cross-linking mechanism.

Most preferably, cross-linking is achieved by irradiating the fiber with an electron beam either as monofilament or in fabric form. The dosage of radiation should be sufficient to cross-link the molecules to the extent that they have a gel content greater than 30% but less than 90%. The preferred gel content is 45–55%. Gel content of the ethylene-vinyl acetate fiber may be determined by means of ahot xylene extraction procedure.

In accordance with my invention, the polymeric material may be partially cross-linked prior to heat setting the drawn solid monofilament. This permits the fiber to be heat set at higher temperatures, and therefore, further increases its shrink resistance. Preferably, in the first cross-linking step the polymeric material is cross-linked to the extent that the gel content is no greater than about 15%, and in the second cross-linking step the polymeric material is partially cross-linked to the extent that the gel content is no greater than 90%.

To enhance radiation cross-linking, there is distributed through-out the polymeric material fine particles of silicon dioxide or titanium dioxide. The particle size of these oxides range between 100 angstroms and 1 micron and the amount used is below 1 volume percent. This small amount of oxide improves the efficiency of the irradiation step. For example, a polymeric material irradiated at a dosage of 10 megarads (MR) will have a gel content of 25–28%. When this same polymer includes 0.2 volume % silicon dioxide and is irradiated at the same dosage, the gel content is 40–45%. This increase in gel content represents a substantial increase in the melting point of the polymeric material. Also the addition of poly-functional monomers improves cross-linking. For example, triallyl cyanurate or allyl acylate, alone or in combination with the oxides, are additives which enhance the cross-linking yield for a given radiation dosage.

In general, due to their larger diameter, my fibers can be loaded with fillers to higher levels than can conventional carpet fibers. Specifically, pigments may be used to color my fiber. Such pigments may be dispersed throughout the molten polymeric material prior to extrusion. These pigments will normally have a particle size in the range of from about 1 to about 25 microns. The amount of pigment normally ranges between about ½ and about 20% of the total weight of the blend.

Exemplary of the pigments which may be employed are organic colorants such as phthalocyanine green and inorganic colorants such as cadmium yellow. Any commonly available colorant which is compatable with the polymer compositions may be used. Fillers which may be used include, for example, silica aerogels, calcium silicate, aluminum silicate, carbon black and alumina in a weight percent as high as 20% or more. Obviously, some of the additives may have more than one function. For example, some of the mineral fillers may also serve as pigments and vice versa, e.g. carbon black and titanium dioxides.

In one embodiment of my invention, pellets of color concentrate are initially prepared. These color concentrate pellets are blended in the extruder with non-colored pellets. The colored and non-colored pellets then melt and mix together thoroughly during the extrusion. It is also possible to color my fiber with a dispersed dye, but under some conditions this type of dye tends to bleed out of the fiber. Cross-linking subsequent to dyeing tends to fix these dyes.

In addition to coloring agents and fillers, it is possible to include in the fiber well known and available flame retardants, antistatic agents, or antisoiling agents. Antioxidants and stabilizers may likewise be added, such as for example, unsaturated benzophenone derivatives described in U.S. Pat. No. 3,214,492, N-N' dinaphthyl p-phenylene diamine, or Irganox 1010, a multi-functional antioxidant having four sterically hindered phenolic groups, available from Ciba-Geigy. Because of the low melting point of the polymers used in the manufacture of my fiber, I can also use additives, especially dyes, flame retardants, antistatic agents and antisoiling agents which are sensitive to, or degrade at, temperatures necessary to process nylon into fiber.

Extrusion temperatures used with certain of my fiber-forming polymers, especially with ethylene-vinyl acetate, do not exceed 500° F. This relatively low extrusion temperature allows me to use hydrated magnesia as a flame or fire retardant. Hydrated magnesia will release its contained water rapidly at temperatures above about 500° F.; a property which precludes its use with nylon and similar polymers. As is well known in the art, hydrated magnesia is a low cost, highly effective fire retardant but, prior to this time, one which could not be used in many thermoplastic fibers.

Figure 4:
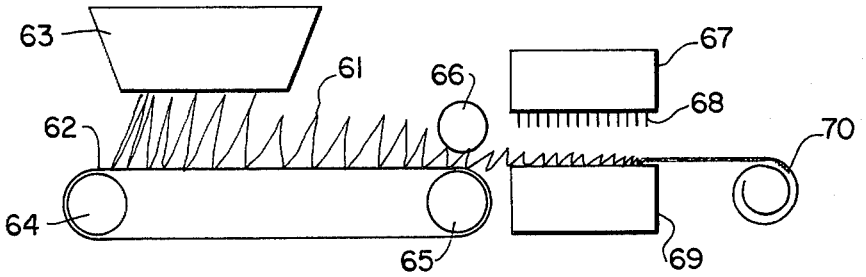
FIG. 4 schematically illustrates needle bonding fibers to form a fabric.

Referring now to FIG. 4, there is shown in diagrammatic form a process for manufacturing the needle bonded fabrics of my invention. Staple length, low modulus fibers 61 are deposited to a uniform thickness upon a work surface 62 by laying techniques such as carding, garnetting or air laying using a cross lapper or similar feeding device 63. Work surface 62 may comprise a continuous moving bed of slats or the like revolving about rollers 64 and 65. A pressure roll 66 may be provided at the discharge end of work surface 62.

Work surface 62 supports and transports the layer of fibers to a needling operation. Needling is accomplished using a conventional, commercially available, needle punching loom 67. The loom carries a plurality of barbed needles 68 which are reciprocated through the fiber layer as it is supported on floating bed plate 69. This punching action serves to intertwine and entangle individual fibers to form a coherent felt or fabric 70.

Figure 5:
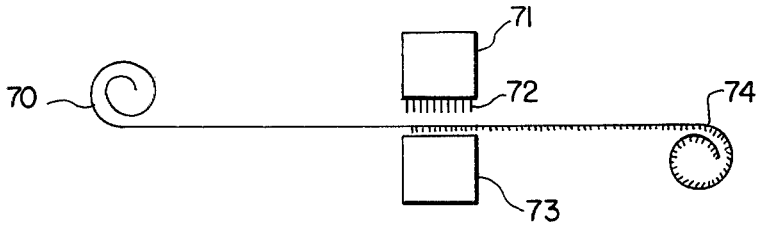
FIG. 5 depicts an optional texture needling operation.

In an optional embodiment, fabric 70 is subjected to a second, or texture needling operation, as is shown in FIG. 5. The second needling is accomplished using a loom 71 designed to produce a textured surface effect on the fabric. The patterning or arrangement of needles 72 on loom 71 can be varied to produce a patterned pile surface having an appearance similar to that of conventional tufted or woven carpets. Loom 72 operates in conjunction with floating bed plate 73 to produce the desired textured surface on fabric 74.

By the use of fibers having a low elastic modulus, from about 5,000 to about 60,000 psi, I can achieve fabric softness and flexibility even with fibers having a diameter of 6 mils or more which is equivalent to a fiber denier of about 150. Were such large fibers of a conventional material, polypropylene for example, used instead the resulting fabric would have an uncomfortably harsh and stiff feel.

The weight of my fabric is dependent upon the use to which they are put. For carpet use, fabric weight may range broadly from about 15 to 50 oz/yd$^2$ with a more preferred range being from about 20 to 35 oz/yd$^2$. It is preferred that the fiber diameters for carpet fabrics range from about 4.5 to 6 mils which is equivalent to a fiber denier of about 80 to 150. As a general rule, I prefer to decrease the elastic modulus as the fiber diameter increases so as to retain the qualities of softness and flexibility even with the largest diameter fibers.

The following examples serve to more fully illustrate specific embodiments of my invention.

EXAMPLE 1

Fabrics were made from ethylene-vinyl acetate staple fibers cut to lengths of 3.0 and 1.5 inches by needle punching on a standard Dilo Loom. The fibers were made of three different resins with varying melt indexes and vinyl acetate contents. The following table sets out the resin characteristics.

TABLE 1

| Sample Number | Melt Index | Vinyl Acetate Content (%) | Elastic Modulus (psi) |
|---|---|---|---|
| 1 | 2.0 | 5 | >35,000 |
| 2 | 9.0 | 9 | >35,000 |
| 3 | 9.0 | 19 | >35,000 |

Fiber diameters used ranged from about 4.5 to 6 mils corresponding to a denier in the range of about 80 to 150. Both staple lengths processed easily and could be converted into a non-woven fabric using conventional equipment. All of the fabrics were attractive in general appearance and were flexible and soft to the touch.

EXAMPLE 2

A number of needle punched fabrics of varying composition and weight were manufactured using a standard needle punching loom and the fabrics were thereafter subjected to testing and evaluation.

Characteristics of the fabrics tested are set out in the following table.

TABLE 2

| Sample No. | Fabric Weight oz/yd$^2$ | Fabric Description |
|---|---|---|
| 1 | 26 | 100% PP[1] needlepunched pile, composed of 60% 24 denier, 3" fiber and 40% 60 denier 3" fiber. |
| 2 | 30 | 40% PP - 60% EVA[2] needlepunched pile, composed of 18–24 denier, 3" PP fiber and 108 denier 3" EVA fiber. |
| 3 | 21 | 60% PP - 40% EVA needlepunched felt, 18–24 denier PP fiber; 108 denier EVA fiber. |
| 4 | 24 | 60% PP - 40% EVA needlepunched felt with scrim backing (sample 5 with scrim) |
| 5 | 20 | 60% PP - 40% EVA needlepunched felt, 18–24 denier PP fiber; 108 denier EVA fiber. |
| 6 | 21 | 30% PP - 70% EVA needlepunched felt with scrim backing, 18–24 denier PP fiber; 108 denier EVA fiber. |
| 7 | 18 | 40% PP - 60% EVA needlepunched felt, 18–24 denier PP fiber, 108 denier lmLD fiber. |
| 8 | 20 | 40% PP - 60% EVA needlepunched felt, 18–24 denier PP fiber, 108 denier EVA fiber. |
| 9 | 50 | 100% PP needlepunched felt, 20 denier fiber. |
| 10 | 50 | 100% EVA needlepunched felt with scrim backing, 108 denier fiber. |

[1]Polypropylene
[2]Low elastic modulus ethylene-vinyl acetate

Each of the fabric samples were subjected to both low and high level compression testing. The low level test consisted of placing the fabric between press platens and cycling between 0 and 10 psi while in the high level test the fabric was cycled between 0 and 50 psi. The 10 psi limit was chosen to stimulate the weight of a standing adult human while the 50 psi loading simulated high stress conditions such as furniture loading and the like. The rate of deflation for each sample for both loading and unloading was maintained at 0.05 in/min.

Samples 1 and 2 were compared to determine the effect of increasing EVA content in needlepunched pile fabrics of similar density. It was concluded that a high EVA content softened the overall feel of the fabric. The bounce at low compression levels was somewhat reduced but the bounce at high compression levels was increased with an increase in EVA content.

The effect of increasing EVA content in needle punched felts of similar weights with scrim backing was evaluated using samples 4 and 6. The same general trends were observed as with those fabrics without a scrim backing.

Samples 3, 5, 7 and 8 were evaluated to determine the effect of increasing EVA content in needle punched felts of similar density. Again it was found that increasing the EVA content tended to lower somewhat the bounce at low compression levels but increase the bounce at high compression levels.

The effect of scrim backing on otherwise equivalent needle punched felts was investigated using samples 4 and 5. It was found that application of a scrim to a felt has no apparent effect on bounce in high stress modes. However, the addition of scrim improves the fabric appearance under low stress conditions but the opposite appeared to be the case under high stress loadings.

Finally, a high density polypropylene needle punched felt (sample 9) was compared to a high density EVA needle punched felt with a scrim backing (sample 10). The larger diameter EVA fibers were found to contribute a softer feel, more bounce and better appearance.

Overall it was concluded that the non-woven fabrics of my invention provide a quality at least equal to prior art fabrics of conventional fibers while offering significant advantages including lower cost, easier cleanability, less tendency to cause floor burns and the like.

I claim:

1. A non-woven, needle punched fabric comprising staple length, polymeric monofilament fibers, said fibers having an elastic modulus in the range of 5,000 to 60,000 psi, an area moment of inertia of from $400\times10^{-14}$ to $7{,}000\times10^{-14}$ in$^4$ and a stiffness parameter of from $1\times10^{-5}$ to $1\times10^{-8}$ lb-in$^2$.

2. The fabric of claim 1 wherein the polymer from which the fiber is produced is selected from the group consisting of ethylene-vinyl acetate copolymers, plasticized polyvinyl chloride, low density polyethylene, ethylene-ethyl acrylate copolymer, ethylene-butylene copolymer, polybutylene, ethylene-propylene copolymers, chlorinated polypropylene, chlorinated polybutylene and compatible mixtures thereof.

3. The fabric of claim 2 wherein the molecules of the polymeric fibers are partially cross-linked.

4. The fabric of claim 3 wherein cross-linking is accomplished by subjecting the fibers to radiation.

5. The fabric of claim 4 wherein the polymeric fibers contain additives which enhance the radiation cross-linking thereof.

6. The fabric of claim 5 wherein said additives are selected from the group consisting of finely divided silicon dioxide, titanium dioxide and mixtures thereof.

7. The fabric of claim 2 wherein the polymeric fibers have dispersed therein one or more additives of the group consisting of colorants, fillers, flame retardants, antistatic agents and antisoiling agents.

8. The fabric of claim 7 where the weight percentage of additives in the fiber based on total fiber weight ranges from 0.5 to 20 percent.

9. The fabric of claim 8 wherein one of said additives is hydrated magnesia.

10. The fabric of claim 2 wherein the fabric weight is in the range of 15 to 50 oz/yd$^2$.

11. The fabric of claim 10 wherein the fiber denier is in the range of 80 to 150.

12. The fabric of claim 10 including a scrim backing.

13. The fabric of claim 1 wherein the polymric fibers comprise ethylene-vinyl acetate.

14. The fabric of claim 13 wherein the vinyl acetate content ranges from 1 to 20 percent by weight.

15. The fabric of claim 14 wherein the ethylene-vinyl acetate molecules are partially cross-linked.

16. The fabric of claim 15 wherein cross-linking is accomplished by subjecting the fibers to radiation.

17. The fabric of claim 16 wherein the ethylene-vinyl acetate fibers contain additives which enhance the radiation cross-linking thereof.

18. The fabric of claim 17 wherein said additives are selected from the group consisting of finely divided silicon dioxide, titanium dioxide and mixtures thereof.

19. The fabric of claim 14 wherein the ethylene-vinyl acetate fibers have dispersed therein one or more additives selected from the group consisting of colorants, fillers, flame retardants, antistatic agents and antisoiling agents.

20. The fabric of claim 19 wherein the weight percentage of additives in the fiber based on total fiber weight ranges from 0.5 to 20 percent.

21. The fabric of claim 20 wherein one of said additives is hydrated magnesia.

22. The fabric of claim 14 wherein the fabric weight is in the range of 15 to 50 oz/yd$^2$.

23. The fabric of claim 22 wherein the fiber denier is in the range of 80 to 150.

24. The fabric of claim 22 including a scrim backing.

25. A method for making a non-woven fabric which comprises:

depositing a uniform layer of thermoplastic staple fibers upon a work surface, said fibers having an elastic modulus in the range of 5,000 to 60,000 psi, an area moment of inertia of from $400\times10^{-14}$ to $7{,}000\times10^{-14}$ in$^4$ and a stiffness parameter of from $1\times10^{-5}$ to $1\times10^{-8}$ lb-in$^2$, and forming a fabric by needling the fibers throughout said layer to intimately intermix and intertwine the fibers.

26. The method of claim 25 wherein said fibers comprise ethylene-vinyl acetate copolymer having a vinyl acetate content ranging from 1 to 20% by weight.

27. The method of claim 26 wherein said ethylene-vinyl acetate is partially cross-linked.

28. The method of claim 27 wherein said cross-linking is accomplished by subjecting the fibers to radiation.

29. The method of claim 28 wherein the fibers contain additives which enhance the radiation cross-linking thereof, said additives selected from the group consisting of finely divided silicon dioxide, titanium dioxide and mixtures thereof.

30. The method of claim 26 wherein the fibers have dispersed therein one of more additives selected from the group consisting of colorants, fillers, flame retardants, antistatic agents and antisoiling agents.

31. The method of claim 30 wherein one of said additives is hydrated magnesia.

32. The method of claim 26 wherein the fabric weight is in the range of 15 to 50 oz/yd$^2$.

33. The method of claim 32 wherein the fiber denier is in the range of 80 to 150.

34. The method of claim 26 wherein said work surface comprises a scrim.

* * * * *